US008814545B2

(12) United States Patent
Li et al.

(10) Patent No.: US 8,814,545 B2
(45) Date of Patent: Aug. 26, 2014

(54) SCROLL-ROTATION PREVENTION ASSEMBLY OF SCROLL COMPRESSOR

(75) Inventors: Hsun-An Li, Taipei (TW); Chung-Hung Yeh, Taipei (TW); Chih-Hao Wei, Taipei (TW); Guang-Der Tarng, Taipei (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 184 days.

(21) Appl. No.: 13/419,427

(22) Filed: Mar. 13, 2012

(65) Prior Publication Data

US 2013/0209304 A1 Aug. 15, 2013

(30) Foreign Application Priority Data

Feb. 13, 2012 (TW) ..... 101202538 A

(51) Int. Cl.
*F01C 1/02* (2006.01)

(52) U.S. Cl.
USPC ..... 418/55.3; 418/55.1; 464/102

(58) Field of Classification Search
USPC ..... 418/55.1, 55.3, 57; 464/102
See application file for complete search history.

(56) References Cited

U.S. PATENT DOCUMENTS 5,141,421 A * 8/1992 Bush et al. ..... 418/55.3
5,281,114 A * 1/1994 Bush ..... 418/1
5,538,408 A * 7/1996 Blass et al. ..... 418/55.3
6,439,867 B1 * 8/2002 Clendenin ..... 418/55.3
7,918,658 B2 * 4/2011 Bush et al. ..... 418/55.3

OTHER PUBLICATIONS

Lovejoy-inc.com catalog "MOL Series—Oldham Center Members (Inserts)." Lovejoy, Inc., 2010. Web. [retrieved on Nov. 7, 2013]. Retrieved from the Internet: http://catalog.lovejoy-inc.com/viewitems/oldham-style-motion-control-couplings-mol-series/ham-style-coupling-center-members-inserts-imperial?#.*

* cited by examiner

*Primary Examiner* — Thai Ba Trieu
*Assistant Examiner* — Thomas Olszewski
(74) *Attorney, Agent, or Firm* — Chun-Ming Shih; HDLS IPR Services

(57) ABSTRACT

A scroll-rotation prevention assembly of a scroll compressor includes a fixed scroll, an orbiting scroll and an Oldham ring. The fixed scroll is positioned in the compressor and has a body. Two blocks extend from the periphery of the body. The orbiting scroll is disposed to correspond to the fixed scroll and has a main body. Two protrusions extend from the periphery of the main body. The Oldham ring is sandwiched between the body of the fixed scroll and the main body of the orbiting scroll. The Oldham ring has a first surface provided with a pair of first troughs and a second surface opposite to the first surface. The second surface is provided with a pair of second troughs. Each protrusion is slidably connected in the first troughs. Each block is slidably connected in the second troughs. Thus, the wear of the Oldham ring can be reduced.

8 Claims, 19 Drawing Sheets

SCROLL-ROTATION PREVENTION ASSEMBLY OF SCROLL COMPRESSOR

BACKGROUND OF THE INVENTION

1. Field of the Invention

The present invention relates to a compressor, and in particular to a scroll-rotation prevention assembly of a scroll compressor.

2. Description of Prior Art

With the advancement of science and technology, scroll compressors are widely used in refrigerators or air conditioners. Generally, the scroll compressor is provided with a pair of spiral scroll elements engaged with each other, including an orbiting scroll and a fixed scroll. The orbiting scroll is rotatable relative to the fixed scroll, thereby defining one or more compression cavities. The sizes of the compression cavities are gradually reduced from an air inlet to an air outlet.

The relative rotation between the spiral orbiting scroll and the spiral fixed scroll is controlled by an Oldham ring. The Oldham ring is fixed between a primary supporting casing and the orbiting scroll. Alternatively, the Oldham ring is fixed between the orbiting scroll and the fixed scroll. The Oldham ring is provided with a protruding key. The orbiting scroll and the fixed scroll are provided with a key slot to correspond to the protruding key respectively. The protruding key is slidably received in the key slot, so that the position of the Oldham ring is restricted by the fixed scroll. Then, the position of the orbiting scroll is restricted by the Oldham ring, thereby preventing the orbiting scroll from rotating. In this way, the compression cavities can be prevented from suffering damage.

However, the protruding key of the Oldham ring repeatedly collides with the key slots of the orbiting scroll and the fixed scroll, resulting in the stress concentration of the protruding key. Further, the Oldham ring is often made of aluminum alloys, while the orbiting scroll and fixed scroll are made of stainless steel. Thus, the hardness of the orbiting scroll or the fixed scroll is larger than the hardness of the Oldham ring, which causes the wear of the Oldham ring. As a result, the Oldham ring has to be replaced periodically, which increases the maintenance cost and reduces the efficiency of the compressor.

In view of the above, the present Inventor proposes a novel and reasonable structure based on his expert knowledge and deliberate researches.

SUMMARY OF THE INVENTION

The present invention is to provide a scroll-rotation prevention assembly of a scroll compressor, in which blocks of the scrolls reciprocate in troughs of the Oldham ring, so that a smaller stress is generated on the Oldham ring to reduce its wear. Thus, the reliability and the lifetime of the Oldham ring are increased.

The present invention provides a scroll-rotation prevention assembly of a scroll compressor, which includes a fixed scroll positioned in the compressor, the fixed scroll having a body, two blocks extending from the periphery of the body; an orbiting scroll disposed to correspond to the fixed scroll, the orbiting scroll having a main body, two protrusions extending from the periphery of the main body; and an Oldham ring provided on one side of the orbiting ring, the Oldham ring having a surface provided with a pair of first troughs and a pair of second troughs, the two protrusions being slidably connected in the pair of first troughs, the two blocks being slidably connected in the pair of second troughs.

The present invention provides a scroll-rotation prevention assembly of a scroll compressor, which includes a fixed scroll positioned in the compressor, the fixed scroll having a body, two protruding blocks extending from the periphery of the body; an orbiting scroll disposed to correspond to the fixed scroll, the orbiting scroll having a main body, two protruding blocks extending from the periphery of the main body; and an Oldham ring sandwiched between the body of the fixed scroll and the main body of the orbiting scroll, the Oldham ring having a first surface and a second surface opposite to the first surface, the first surface being provided with a pair of first troughs, the second surface being provided with a pair of second troughs, the two protrusions being slidably connected in the pair of first troughs, the two blocks being slidably connected in the pair of second troughs.

The present invention has the following advantageous features. When a driven blade is inserted and rotated into a positioning blade, the position of the Oldham ring is restricted by the fixed scroll, and in turn the position of the orbiting scroll is restricted by the Oldham ring. In this way, the rotation of the orbiting scroll can be prevented, and the compression cavities can be prevented from suffering damage.

In comparison with the conventional Oldham ring, the Oldham ring of the present invention is provided with the first troughs and the second troughs, the structural strength of the Oldham ring of the present invention is larger than conventional one. When the blocks reciprocate in a first direction relative to the first trough, and the protrusions reciprocate in a second direction relative to the second trough, a smaller stress is generated on the Oldham ring, thereby reducing the wear of the Oldham ring. Further, the reliability and the life of the Oldham ring are increased.

Further, the first troughs and the second troughs may be not coaxial with the Oldham ring, thereby reducing the operating space and the whole volume of the Oldham ring.

DETAILED DESCRIPTION OF THE INVENTION

Figure 1:
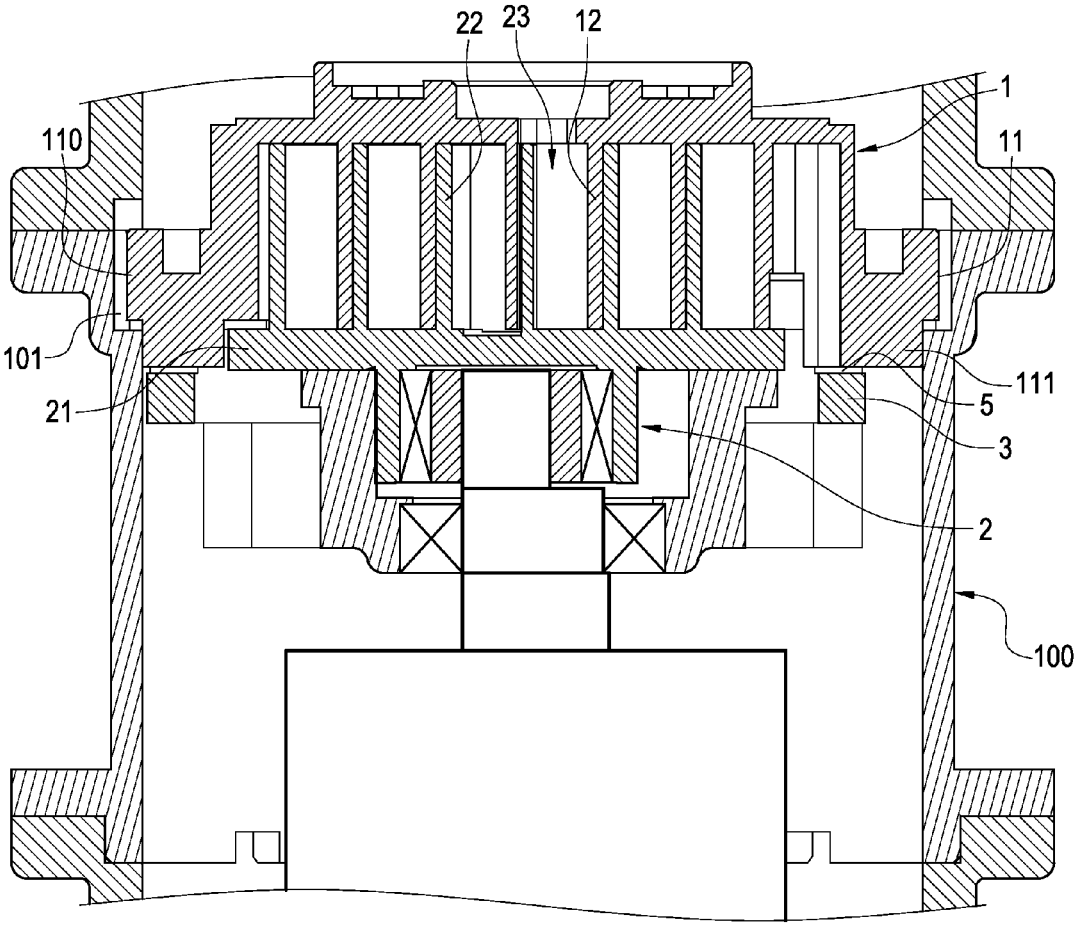
FIG. 1 is an assembled schematic view showing the scroll compressor of the present invention.
Figure 2:
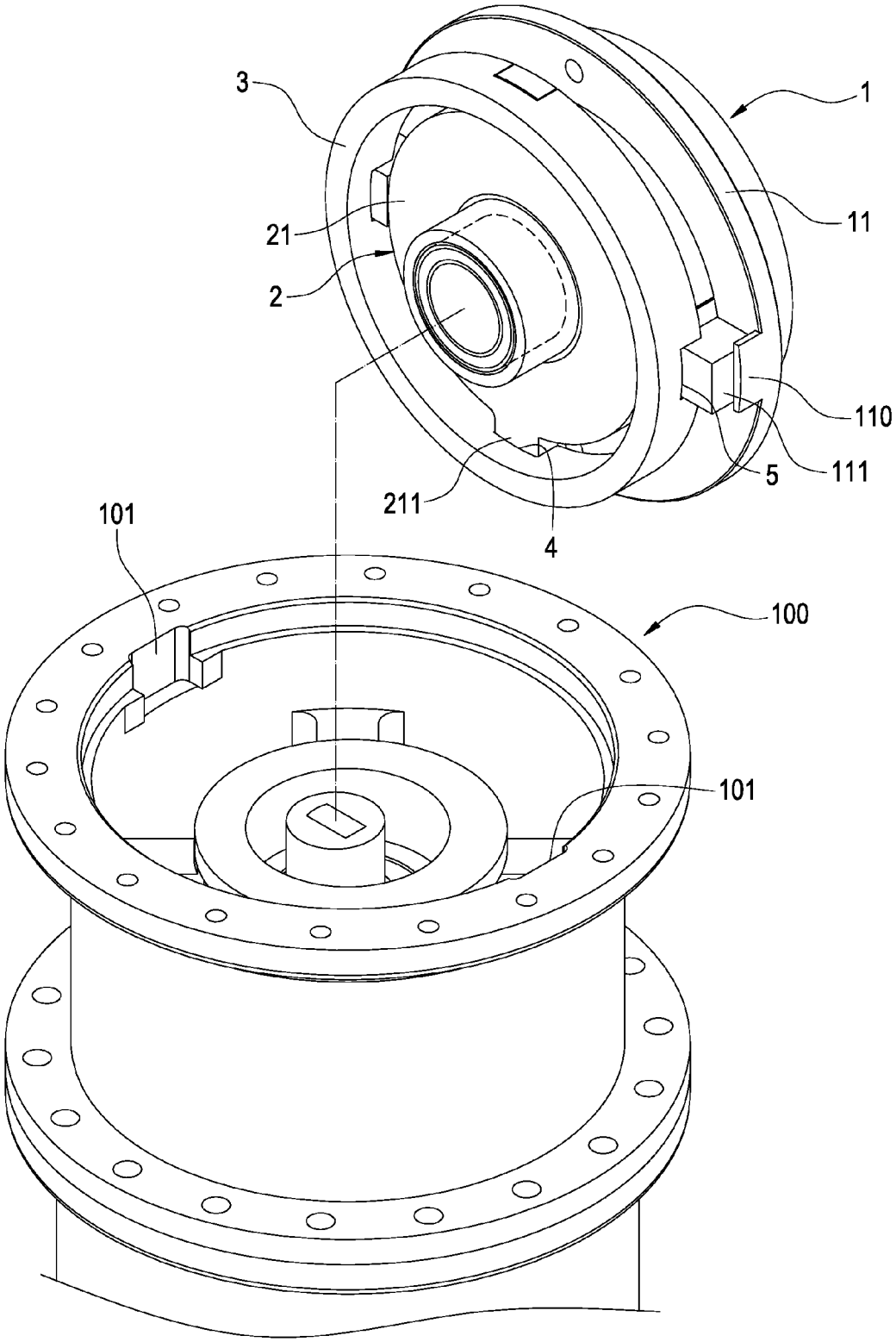
FIG. 2 is an exploded perspective view showing the scroll compressor and the scroll-rotation prevention assembly of the present invention.

The detailed description and technical contents of the present invention will become apparent with the following detailed description accompanied with related drawings. It is noteworthy to point out that the drawings is provided for the illustration purpose only, but not intended for limiting the scope of the present invention.

Please refer to FIGS. 1 to 7. The present invention provides a scroll-rotation prevention assembly of a scroll compressor. The compressor 100 are provided with two recessed portions 101. The scroll-rotation prevention assembly includes a fixed scroll 1, an orbiting scroll 2, and an Oldham ring 3.

The fixed scroll 1 is positioned in the compressor 100. Specifically speaking, the fixed scroll 1 has a body 11. The body 11 has two protruding portions 110 engaged with the recessed portions 101 respectively, so that the fixed scroll 1 can be positioned in the compressor 100. The interior of the body 11 is provided with a positioning blade 12. Two blocks 111 extend from the periphery of the body 11 of the fixed scroll 1.

The orbiting scroll 2 is arranged to correspond to the fixed scroll 1. The orbiting scroll 2 has a main body 21. The interior of the orbiting scroll 2 is provided with a driven blade 2. Two protrusions 211 extend from the periphery of the main body 21. The driven blade 22 is inserted and rotated into the positioning blade 12, so that a plurality of compression cavities 23 can be formed between the body 11 of the fixed scroll 1 and the main body 21 of the orbiting scroll 2.

Figure 3:
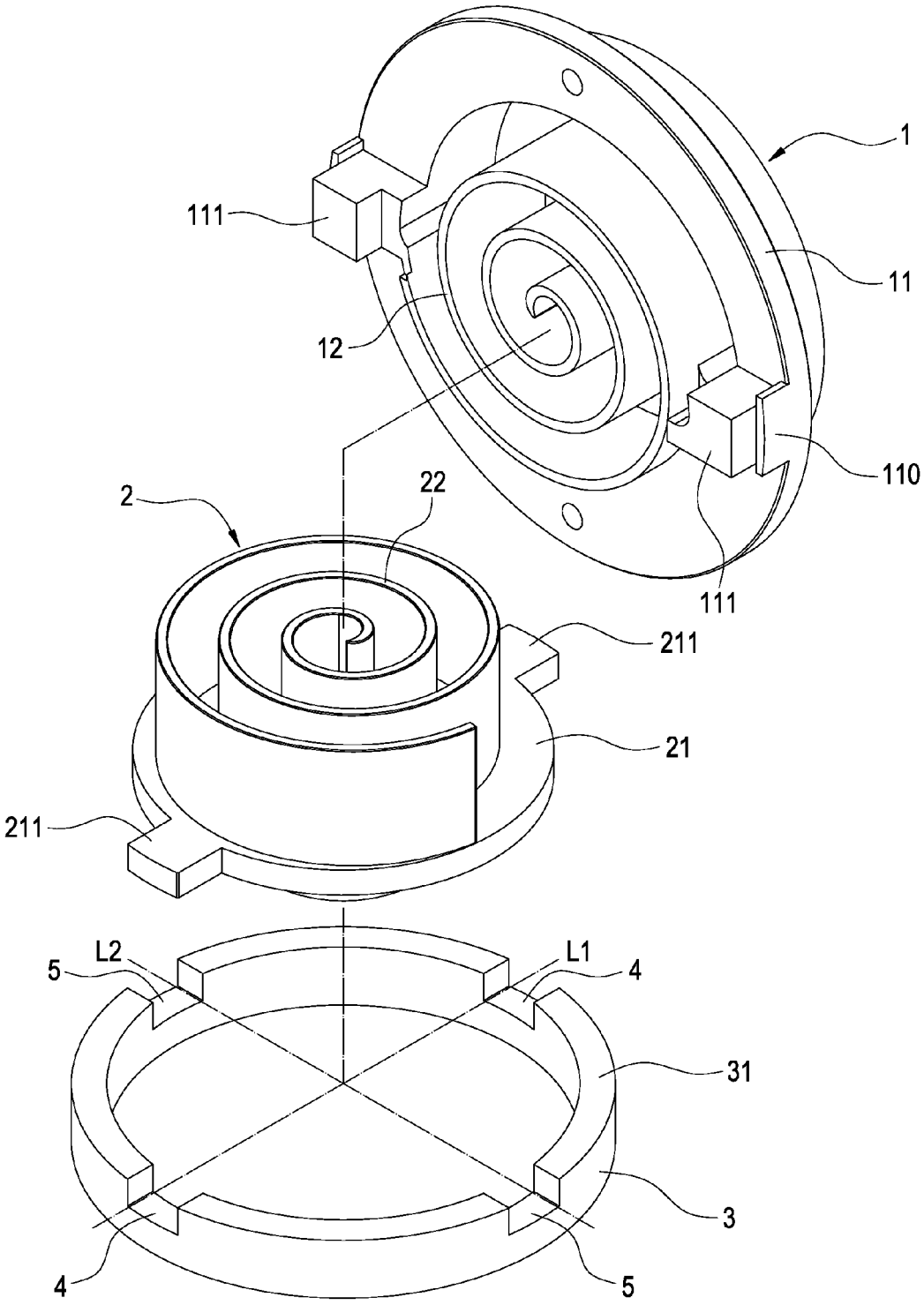
FIG. 3 is an exploded perspective view showing the scroll-rotation prevention assembly of the present invention.
Figure 4:
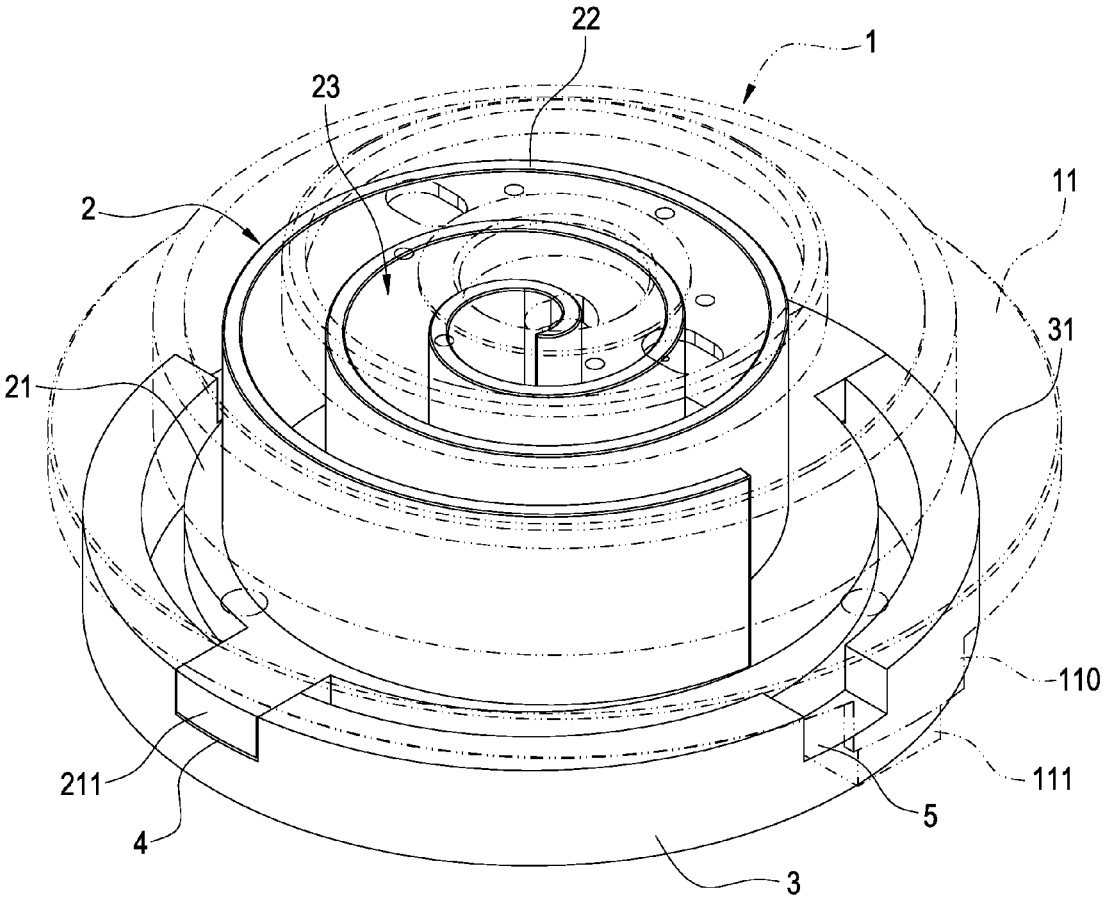
FIG. 4 is an assembled view showing the scroll-rotation prevention assembly of the present invention.
Figure 5:
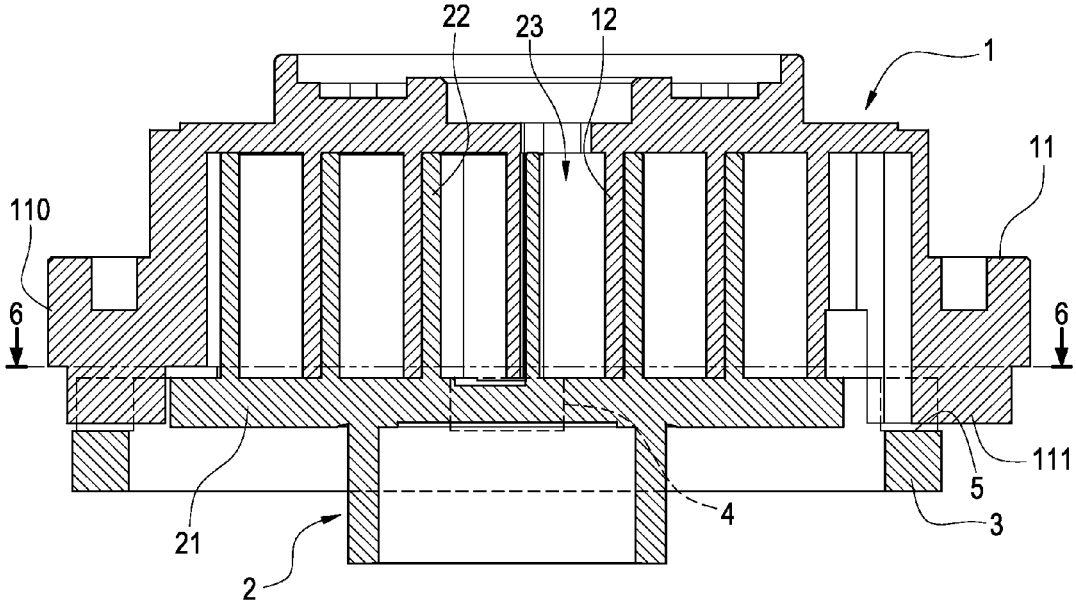
FIG. 5 is a cross-sectional view showing the scroll-rotation prevention assembly of the present invention.
Figure 6:
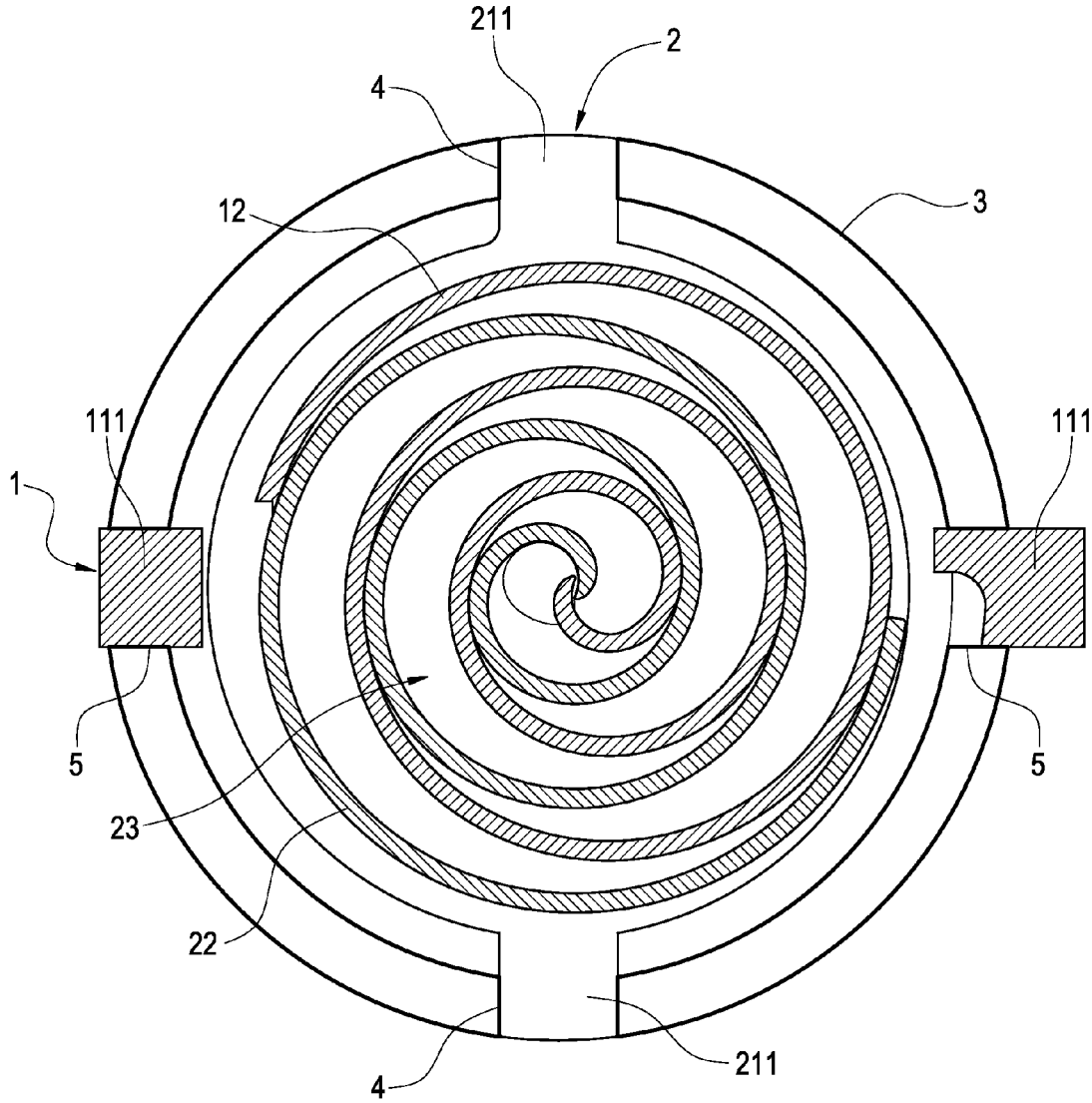
FIG. 6 is a schematic view showing the operating state of the scroll-rotation prevention assembly of the present invention.
Figure 7:
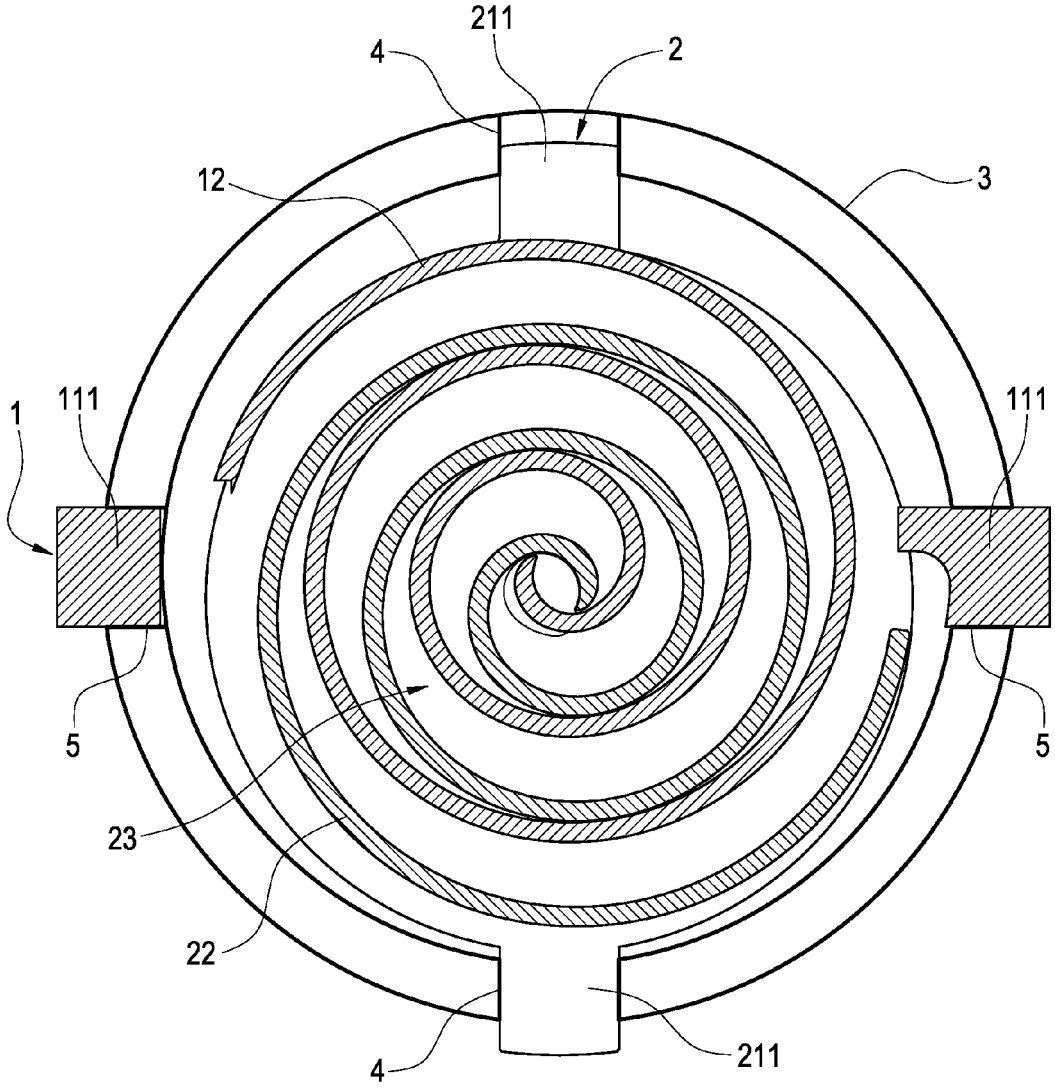
FIG. 7 is a schematic view showing another operating state of the scroll-rotation prevention assembly of the present invention.
Figure 8:
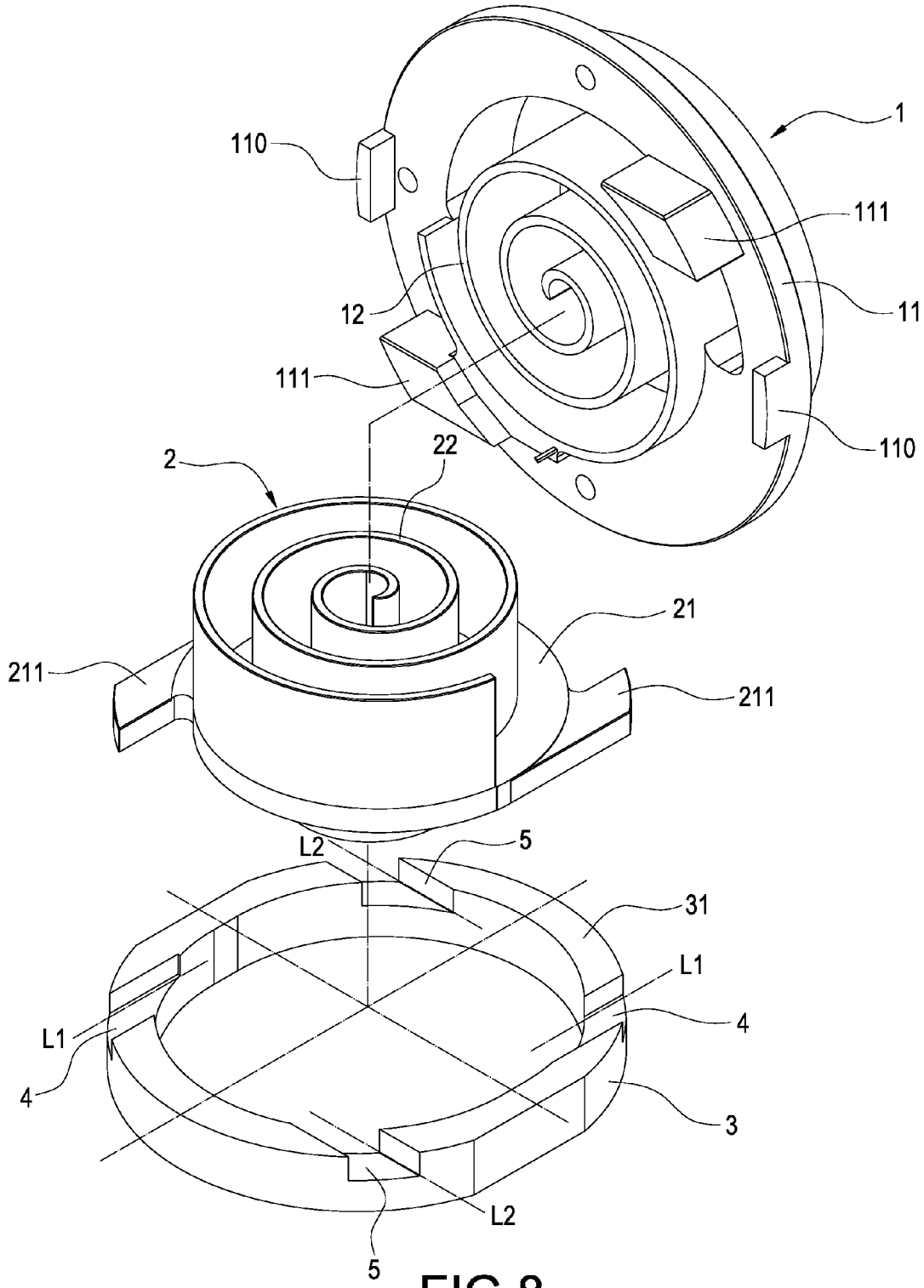
FIG. 8 is an exploded perspective view showing the scroll-rotation prevention assembly according to another embodiment of the present invention.
Figure 9:
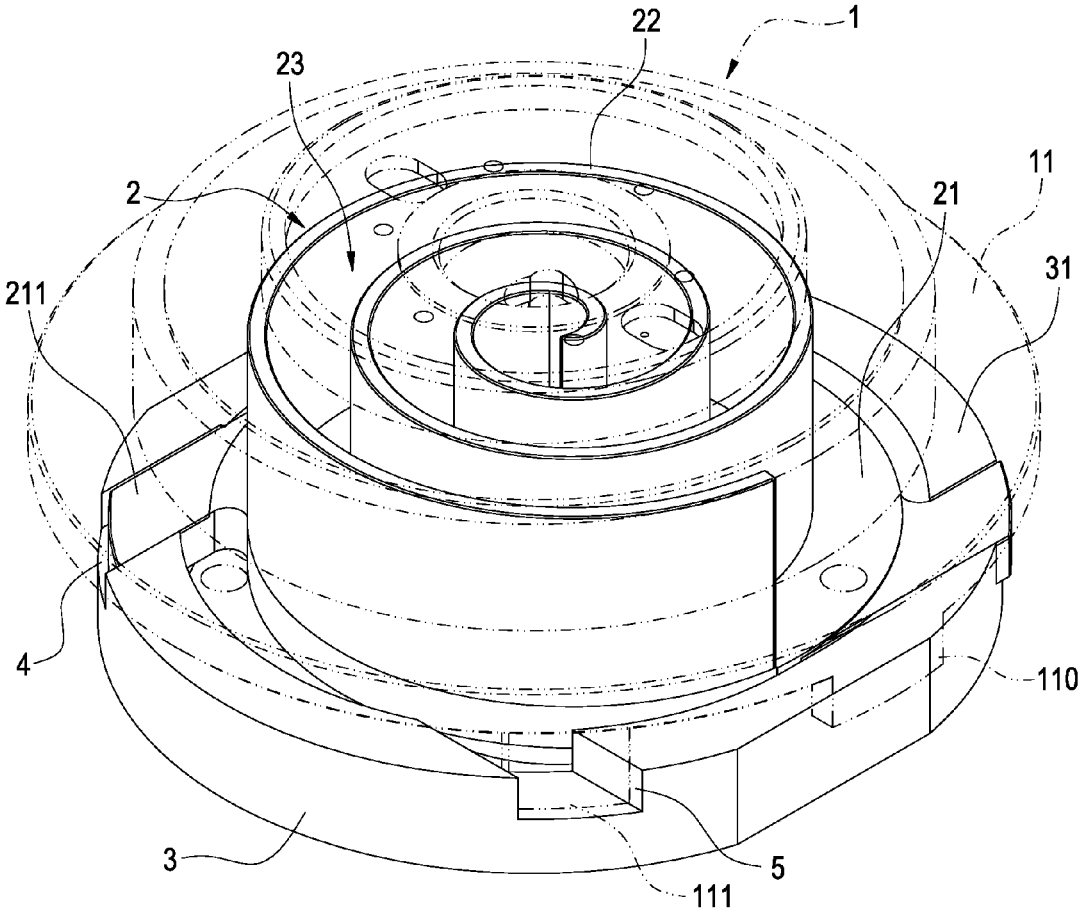
FIG. 9 is an assembled view showing the scroll-rotation prevention assembly according to another embodiment of the present invention.
Figure 10:
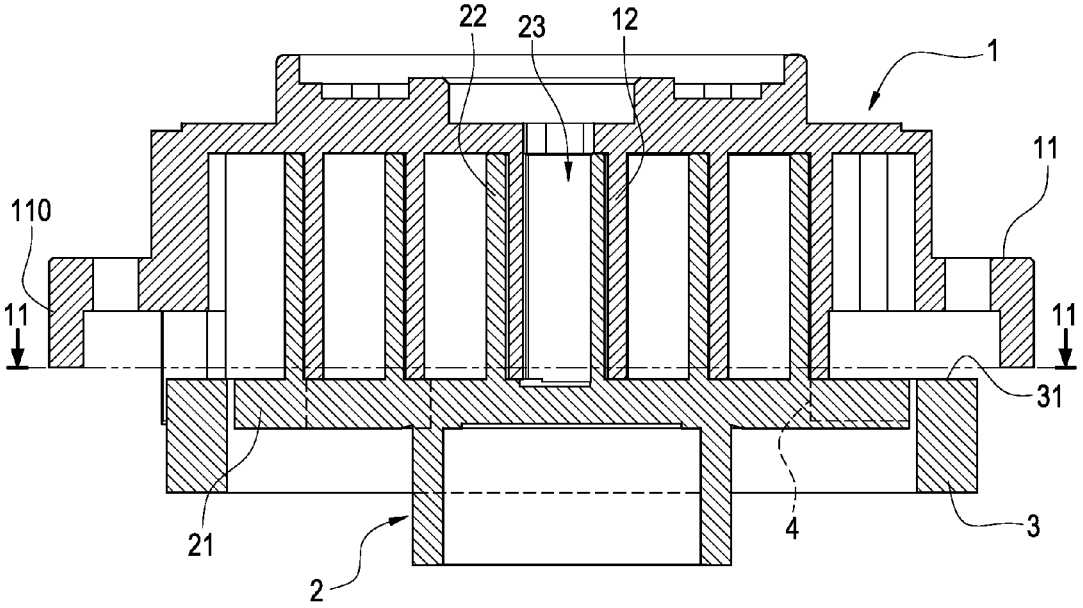
FIG. 10 is a cross-sectional view showing the scroll-rotation prevention assembly according to another embodiment of the present invention.
Figure 11:
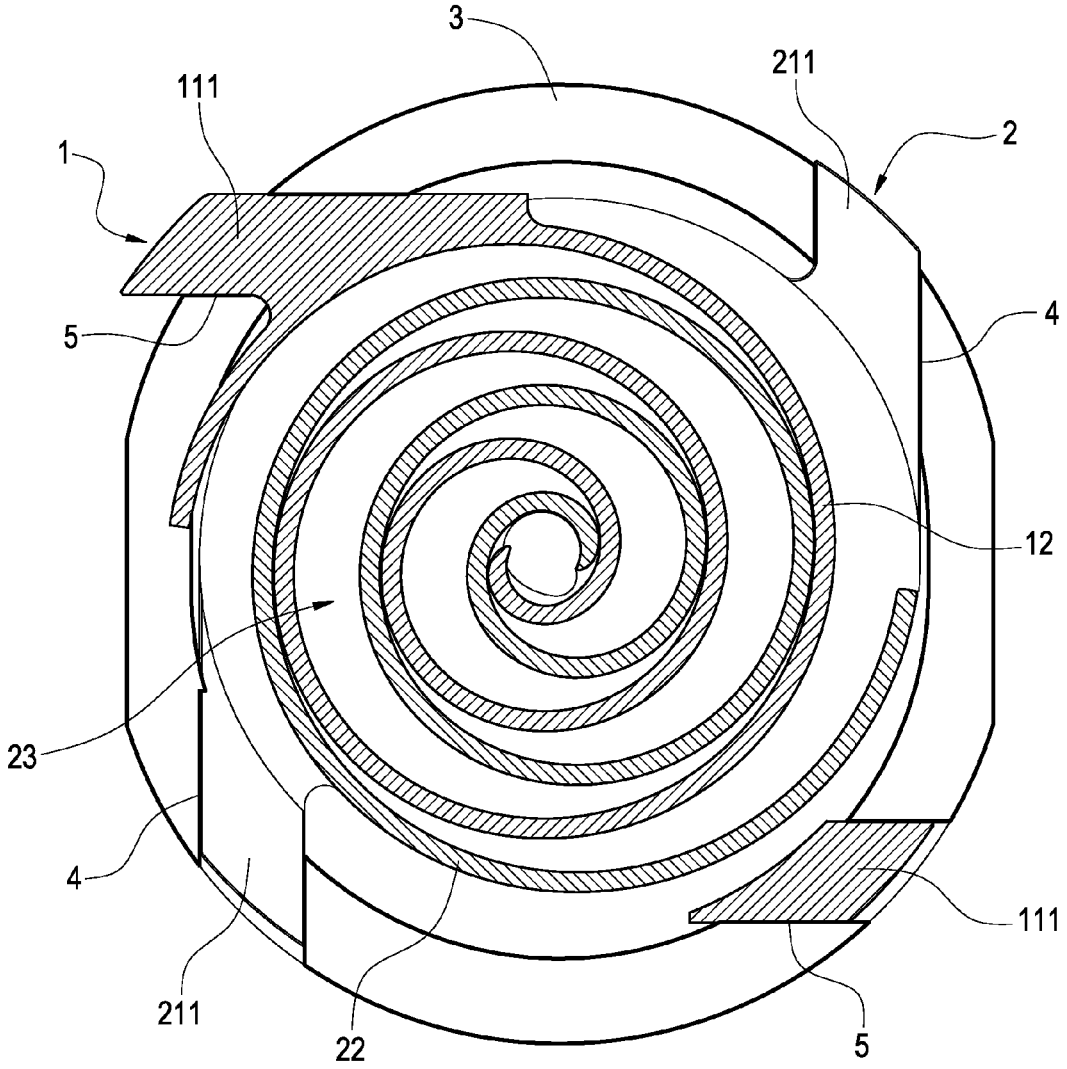
FIG. 11 is a schematic view showing the operating state of the scroll-rotation prevention assembly according to another embodiment of the present invention.
Figure 12:
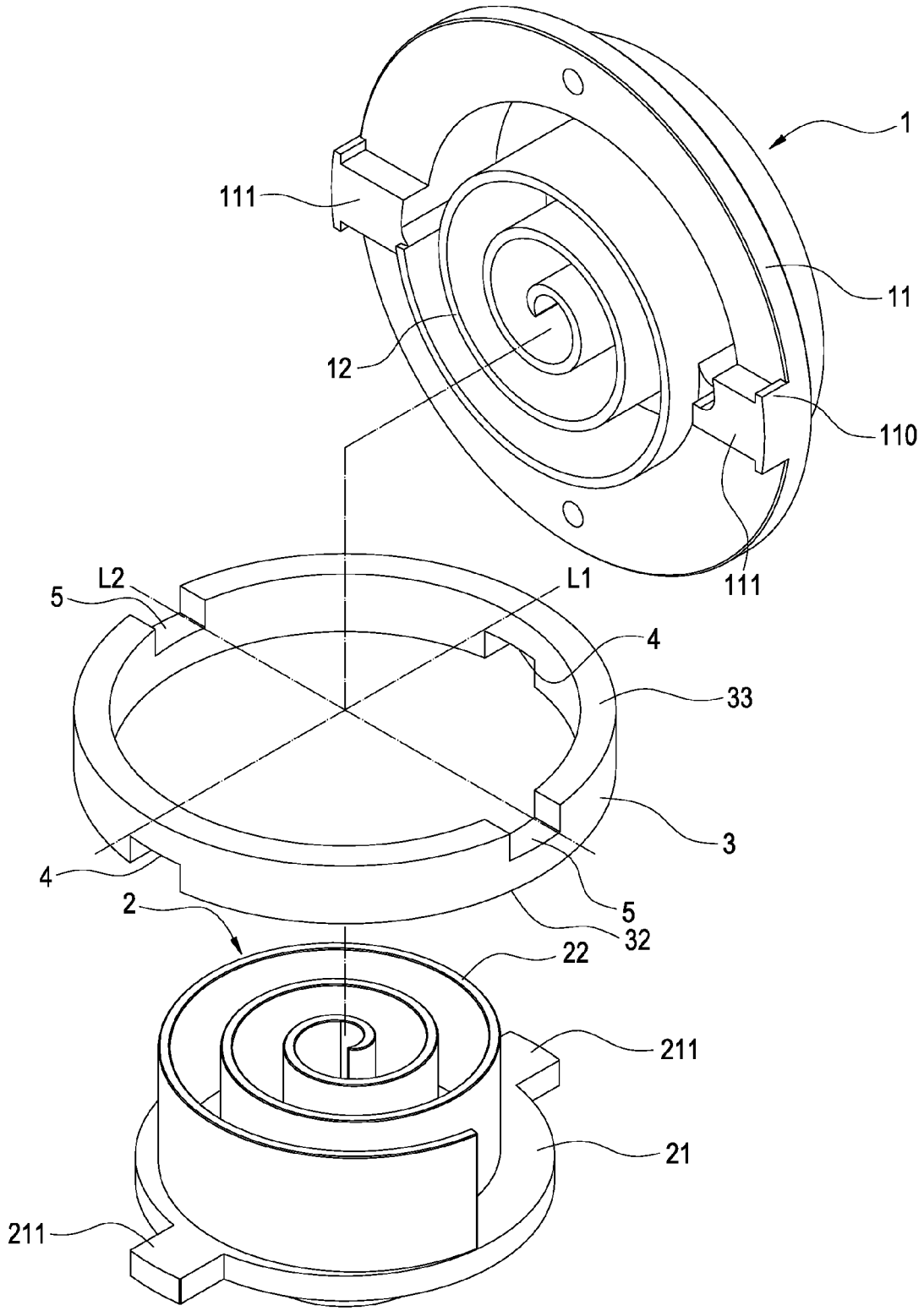
FIG. 12 is an exploded perspective view showing the scroll-rotation prevention assembly according to a further embodiment of the present invention.
Figure 13:
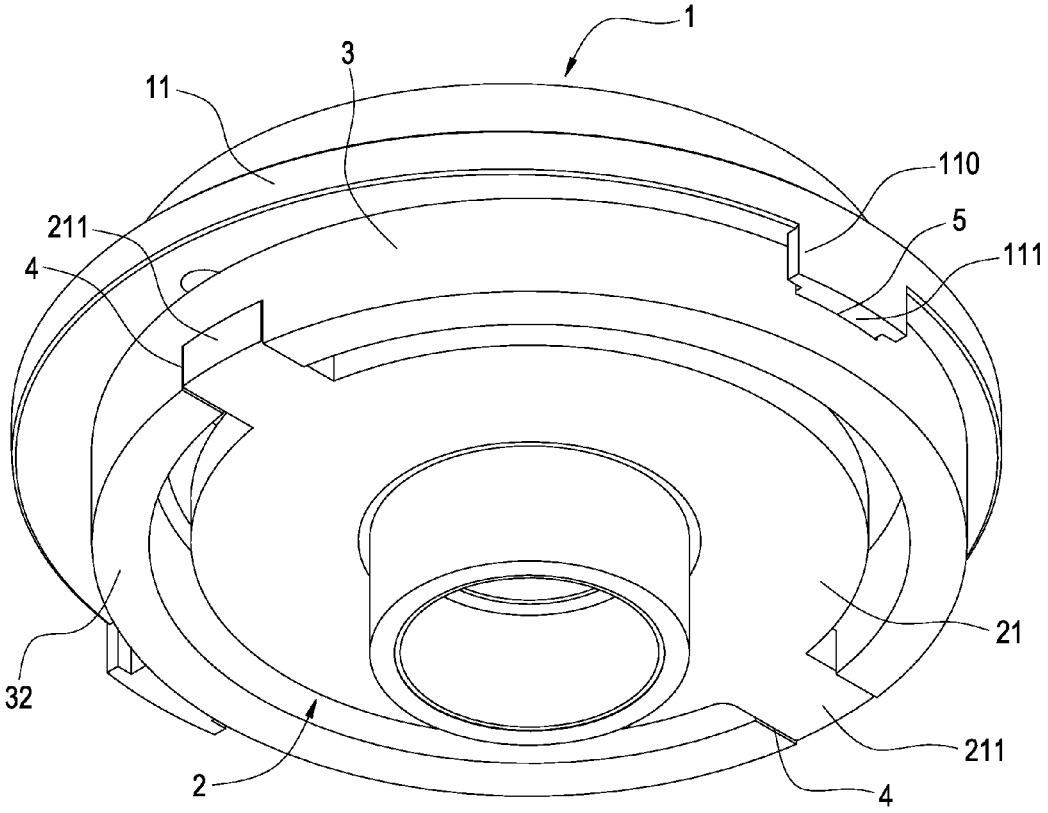
FIG. 13 is an assembled view showing the scroll-rotation prevention assembly according to a further embodiment of the present invention.
Figure 14:
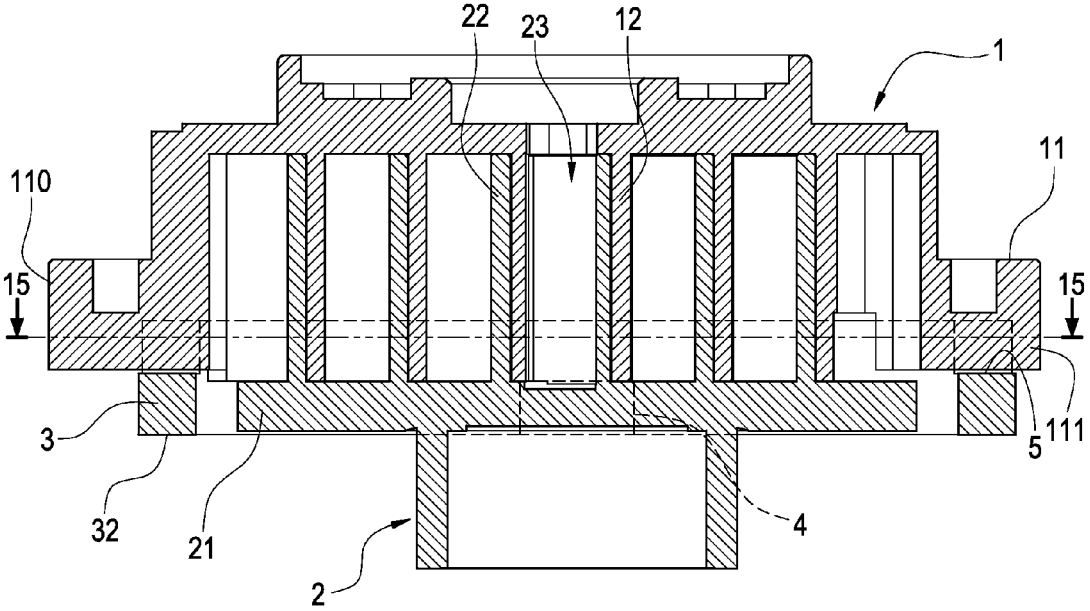
FIG. 14 is a cross-sectional view showing the scroll-rotation prevention assembly according to a further embodiment of the present invention.
Figure 15:
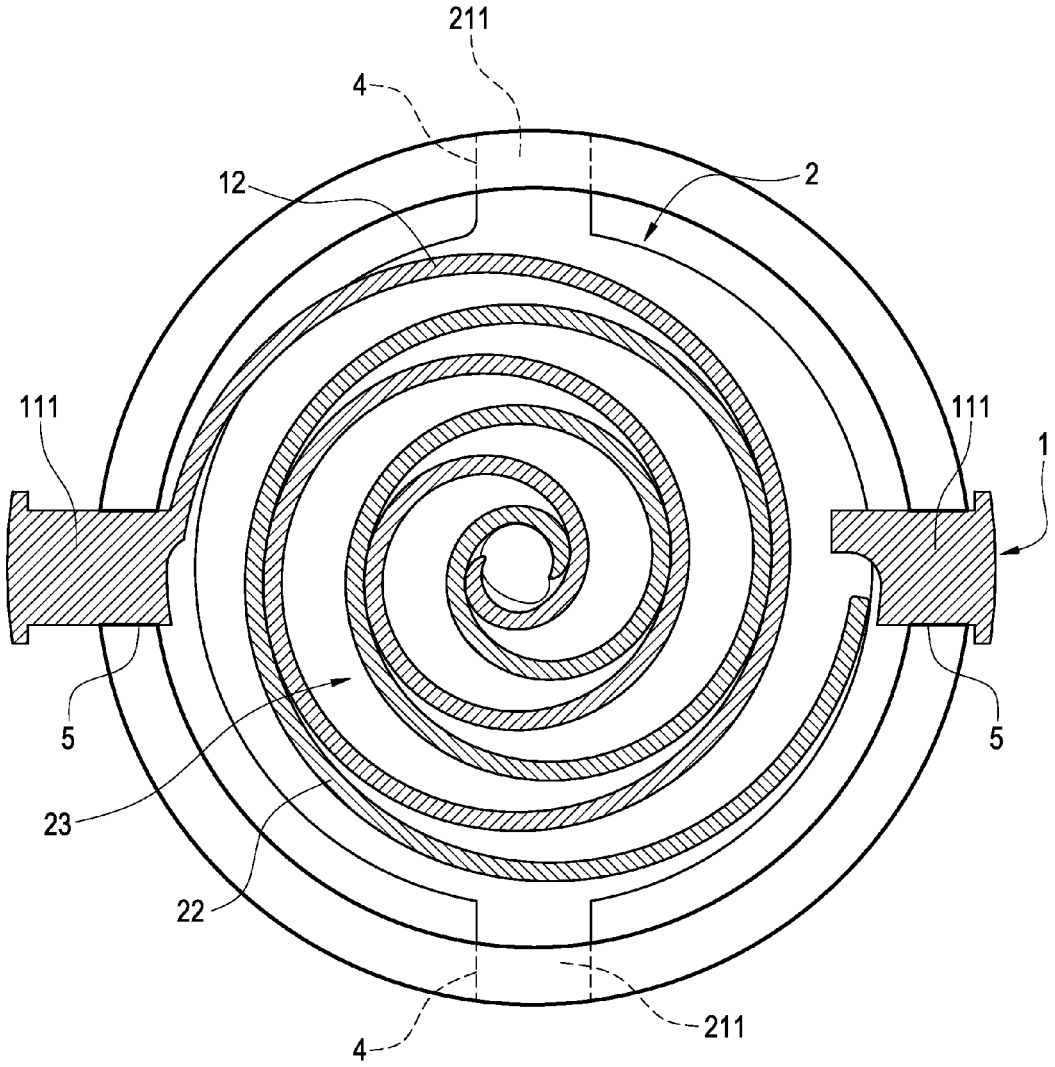
FIG. 15 is a schematic view showing an operating state of the scroll-rotation prevention assembly according to a further embodiment of the present invention.
Figure 16:
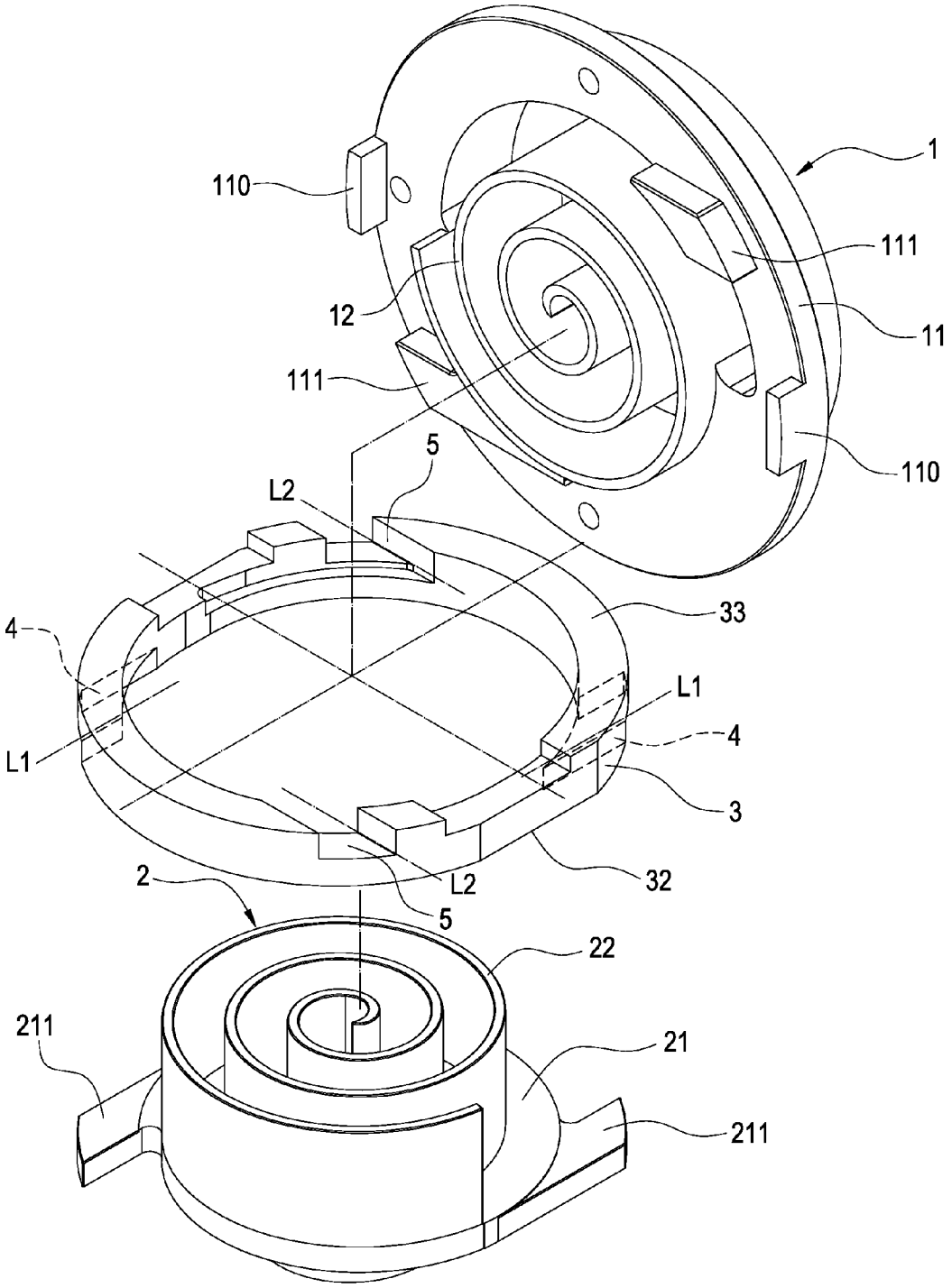
FIG. 16 is an exploded perspective view showing the scroll-rotation prevention assembly according to a still further embodiment of the present invention.
Figure 17:
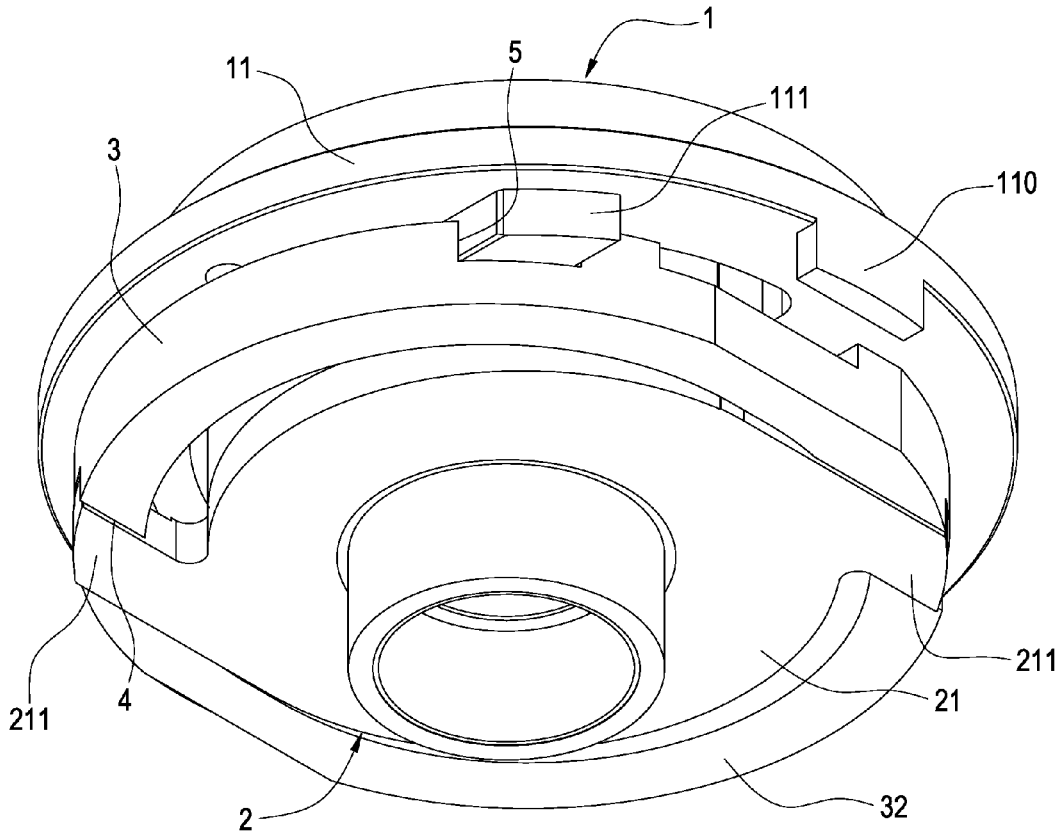
FIG. 17 is an assembled view showing the scroll-rotation prevention assembly according to a still further embodiment of the present invention.
Figure 18:
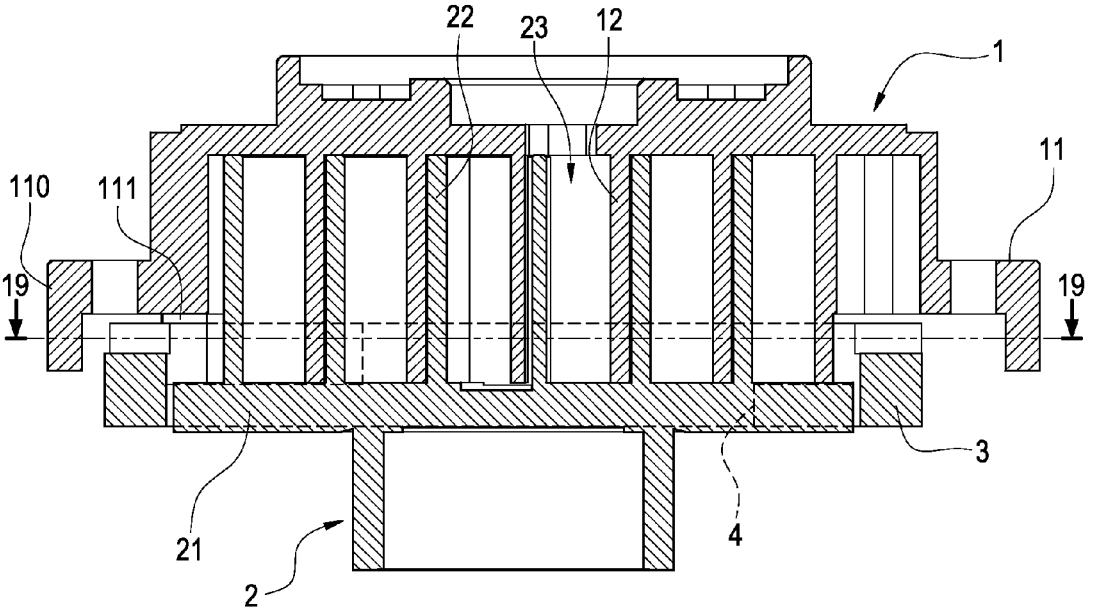
FIG. 18 is a cross-sectional view showing the scroll-rotation prevention assembly according to a still further embodiment of the present invention.
Figure 19:
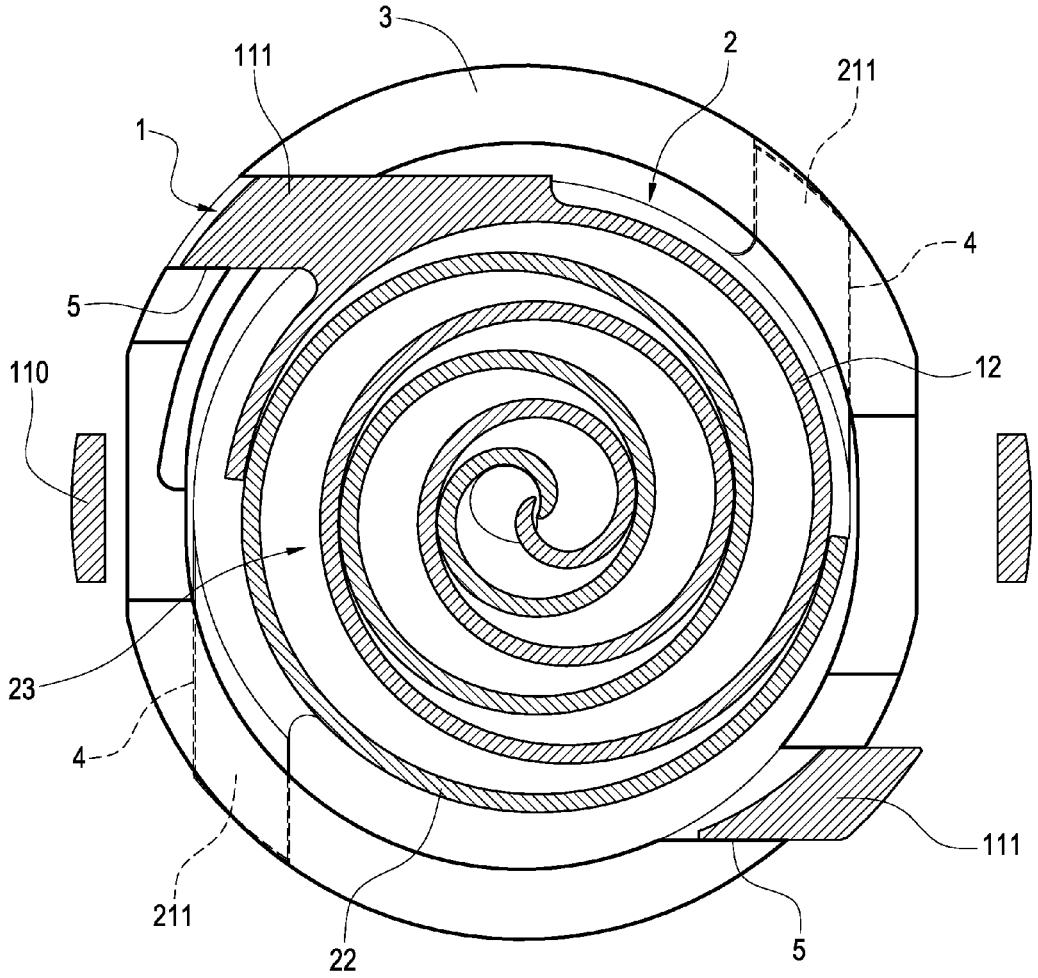
FIG. 19 is a schematic view showing the operating state of the scroll-rotation prevention assembly according to a still further embodiment of the present invention.

The Oldham ring 3 is provided on one side of the orbiting ring 2. The Oldham ring 3 has a surface 31 provided with a pair of first troughs 4 and a pair of second troughs 5. More specifically, as shown in FIG. 3, the extension line L1 of the pair of first troughs 4 and the extension line L2 of the pair of the second troughs 5 are coaxial with the Oldham ring 3. The protrusions 211 are slidably inserted into the first troughs 4 respectively and restricted therein. That is, the protrusion 211 is moveable but not rotatable in the first trough 4. Similarly, the blocks 111 are slidably inserted into the second troughs 5 respectively and restricted therein. That is, the block 111 is moveable but not rotatable in the second trough 5. Since the protrusion 211 is restricted in the first trough 4, so that the orbiting scroll 2 can only reciprocate in a first direction relative to the Oldham ring 3. Since the block 111 is restricted in the second trough 5, so that the Oldham ring 3 can only reciprocate in a second direction relative to the fixed scroll 1. The reciprocating movement in the first direction is perpendicular to the reciprocating movement in the second direction.

In the scroll-rotation prevention assembly of the present invention, the fixed scroll 1 is positioned in the compressor 100. The fixed scroll 1 has the body 11. Two blocks 111 extend from the periphery of the body 11. The orbiting scroll 2 is arranged to correspond to the fixed scroll 1. The orbiting scroll 2 has a main body 21. Two protruding block 211 extend from the periphery of the main body 21. The Oldham ring 3 is provided on one side of the orbiting scroll 2. The Oldham 3 has a surface 31 provided with the pair of first troughs 4 and the pair of second troughs 5. The two protrusions 211 are slidably connected in the pair of the first troughs 4. The two blocks 111 are slidably connected in the pair of the second troughs 5.

When the driven blade 22 is inserted and rotated in the positioning blade 12, the Oldham ring 3 is restricted by the fixed scroll 1. As a result, the orbiting scroll 2 is restricted by the Oldham ring 3, thereby preventing the orbiting scroll 2 from rotating and preventing the compression cavities 23 from suffering damage.

In comparison with the conventional Oldham ring, the Oldham ring 3 of the present invention is provide with the firs troughs 4 and the second troughs 5, so that the structural strength of the Oldham ring 3 is larger. Further, when the block 111 reciprocates in the first direction relative to the first trough 4, and the protrusion 211 reciprocates in the second direction relative to the second trough 5, a smaller stress is generated on the Oldham ring 3, which protects the Oldham ring 3 from wearing. Thus, the reliability and the lifetime of the Oldham ring 3 are increased.

Please refer to FIGS. 8 to 11, which show the scroll-rotation prevention assembly according to another embodiment of the present invention. The extension line L1 of the pair of the first troughs 4 and the extension line L2 of the pair of the second troughs 5 are coaxial with the Oldham ring 3. By using the orbit of the orbiting scroll 2, the optimal positions of the first troughs 4 and the second troughs 5 can be determined. In this way, the operating space of the Oldham ring 3 and the whole volume of the Oldham ring 3 can be reduced. Thus, the positions of the first troughs 4 and the second troughs 5 relative to the Oldham ring 3 can be adjusted based on practical demands, so that the extension line L1 of the pair of the first troughs 4 and the extension line L2 of the pair of the second troughs 5 may be coaxial with the Oldham ring 3 or not.

Please refer to FIGS. 12 to 19, which show the scroll-rotation prevention assembly according to a further embodiment and a still further embodiment of the present invention. The Oldham ring 3 is sandwiched between the body 11 of the fixed scroll 1 and the main body 21 of the orbiting scroll 2. The Oldham ring 3 has a first surface 32 and a second surface 33 opposite to the first surface 32. The first surface 32 is provided with the pair of the first troughs 4. The second surface 33 is provided with the pair of the second troughs 5. According to the position of the Oldham ring 3, the first troughs 4 and the second troughs 5 may be provided on one surface or two opposite surfaces of the Oldham ring 3 to thereby achieve the same effect as that of the previous embodiment.

The extension line L1 of the pair of the first troughs 4 and the extension line L2 of the pair of the second troughs 5 may be coaxial with the Oldham ring 3 or not. When the extension line L1 of the pair of the first troughs 4 and the extension line L2 of the pair of the second troughs 5 are not coaxial with the Oldham ring 3, the operating space and whole volume of the Oldham ring 3 are reduced.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A scroll-rotation prevention assembly of a scroll compressor, including:

a fixed scroll positioned in the compressor, the fixed scroll having a body, and two blocks extending from the periphery of the body;

an orbiting scroll disposed to correspond to the fixed scroll, the orbiting scroll having a main body, and two protrusions extending from the periphery of the main body; and an Oldham ring provided on one side of the orbiting scroll, the Oldham ring having a surface provided with a pair of first troughs and a pair of second troughs, the two protrusions being slidably engaged with the pair of first troughs, respectively, so the orbiting scroll and the Oldham ring are coupled with each other, the two blocks being slidably engaged with the pair of second troughs, respectively, so the fixed scroll and the Oldham ring are coupled with each other, wherein the pair of the first troughs is extended along a first direction, and the positions of the two protrusions are restricted by the pair of the first troughs to make the orbiting scroll to reciprocate in the first direction relative to the Oldham ring, wherein the pair of the second troughs is extended along a second direction, and the positions of the two blocks are restricted by the pair of the second troughs to make the Oldham ring to reciprocate in a second direction relative to the fixed scroll, and wherein the first direction is perpendicular to the second direction.

2. The scroll-rotation prevention assembly of a scroll compressor according to claim 1, wherein the body of the fixed scroll is provided with a positioning blade, the main body of the orbiting scroll is provided with a driven blade, and the driven blade is inserted and rotated in the positioning blade to form a plurality of compression cavities between the body of the fixed scroll and the main body of the orbiting scroll.

3. The scroll-rotation prevention assembly of a scroll compressor according to claim 1, wherein an extension line of the pair of the first troughs and an extension line of the pair of the second troughs are coaxial with the Oldham ring.

4. The scroll-rotation prevention assembly of a scroll compressor according to claim 1, wherein an extension line of the pair of the first troughs and an extension line of the pair of the second troughs are not coaxial with the Oldham ring.

5. A scroll-rotation prevention assembly of a scroll compressor, including:

fixed scroll positioned in the compressor, the fixed scroll having a body, and two blocks extending from the periphery of the body;

an orbiting scroll disposed to correspond to the fixed scroll, the orbiting scroll having a main body, and two protrusions extending from the periphery of the main body; and an Oldham ring sandwiched between the body of the fixed scroll and the main body of the orbiting scroll, the Oldham ring having a first surface and a second surface opposite to the first surface, the first surface being provided with a pair of first troughs, the second surface being provided with a pair of second troughs, the two protrusions being slidably engaged with the pair of first troughs, respectively, so the orbiting scroll and the Oldham ring are coupled with each other, the two blocks being slidably engaged with the pair of second troughs, respectively, so the fixed scroll and the Oldham ring are coupled with each other, wherein the pair of the first troughs is extended along a first direction, and the positions of the two protrusions are restricted by the pair of the first troughs to make the orbiting scroll to reciprocate in the first direction relative to the Oldham ring, wherein the pair of the second troughs is extended along a second direction, and the positions of the two blocks are restricted by the pair of the second troughs to make the Oldham ring to reciprocate in a second direction relative to the fixed scroll, and wherein the first direction is perpendicular to the second direction.

6. The scroll-rotation prevention assembly of a scroll compressor according to claim 5, wherein the body of the fixed scroll is provided with a positioning blade, the main body of the orbiting scroll is provided with a driven blade, and the driven blade is inserted and rotated in the positioning blade to form a plurality of compression cavities between the body of the fixed scroll and the main body of the orbiting scroll.

7. The scroll-rotation prevention assembly of a scroll compressor according to claim 5, wherein an extension line of the pair of the first troughs and an extension line of the pair of the second troughs are coaxial with the Oldham ring.

8. The scroll-rotation prevention assembly of a scroll compressor according to claim 5, wherein an extension line of the pair of the first troughs and an extension line of the pair of the second troughs are not coaxial with the Oldham ring.

* * * * *